US005860471A

United States Patent [19]

Perryment et al.

[11] Patent Number: 5,860,471

[45] Date of Patent: Jan. 19, 1999

[54] HEAT EXCHANGE DEVICE

[76] Inventors: Alan John Perryment, Kingfisher Barn, The Common, Mellis, Eye, United Kingdom, IP23 8EF; Colin Michael Stanley, 6 Milfield Road Barningham, Bury St Edmunds, United Kingdom, IP31 1DY

[21] Appl. No.: 737,308

[22] PCT Filed: May 12, 1995

[86] PCT No.: PCT/GB95/01078

§ 371 Date: Jan. 13, 1997

§ 102(e) Date: Jan. 13, 1997

[87] PCT Pub. No.: WO95/31686

PCT Pub. Date: Nov. 23, 1995

[30] Foreign Application Priority Data

May 13, 1994 [GB] United Kingdom ..... 9409774

[51] Int. Cl.[6] ..... F25B 39/02; F28F 3/14

[52] U.S. Cl. ..... 165/170; 62/349

[58] Field of Search ..... 165/140, 170; 62/349, 352

[56] References Cited

U.S. PATENT DOCUMENTS 2,190,280 2/1940 Banigan et al. ..... 165/170 X
2,805,557 9/1957 Hilger ..... 165/170
3,126,215 3/1964 Raskin ..... 165/170 X
3,322,190 5/1967 Johnson, Jr. ..... 165/170 X
3,423,952 1/1969 Pugh ..... 62/347 X

*Primary Examiner*—Allen Flanigan
*Attorney, Agent, or Firm*—Charles D. Gunter, Jr.

[57] ABSTRACT

Heat exchange device adapted to extract or impart thermal energy from or to a body, which device comprises: a) a first plate assembly (1) comprising a substantially rigid first sheet member (4) having attached thereto a second sheet member (6) which is substantially congruent to the first member (4) and is formed with localised raised areas extending in either or both directions from the median plane of the second sheet member (6), the attachment around the periphery of the said sheet members (4, 6) being a sealing attachment so as to provide a sealed enclosure between the two sheet members (4, 6), the attachment within the plan area of the enclosure being intermittent and located at the point of contact of at least some of the raised areas of said second sheet member (6) with the opposed surface of said first sheet member (4), there being provided an inlet (20) for a heat exchange fluid to said enclosure and an outlet (21) for heat exchange fluid from said enclosure whereby heat exchange fluid can be caused to flow through said enclosure and cool or warm said first plate assembly (1); and b) a second plate assembly (2) of substantially the same construction and configuration as said first plate assembly (1) and positioned substantially parallel to said first plate assembly (1) with the second sheet members (6, 7) of the said plate assemblies (1, 2) being opposed to one another. Plate freezer which uses such a heat exchange device.

3 Claims, 3 Drawing Sheets

HEAT EXCHANGE DEVICE

The present invention relates to a device, notably to a heat exchanger plate for a plate freezer.

BACKGROUND TO THE INVENTION

Many foodstuffs are heated, cooled, frozen or otherwise treated thermally by holding them in, or passing them through, the parallel gaps between adjacent horizontal plates of an horizontal plate heat exchanger, for example an horizontal plate freezer; or by holding the foodstuff in the vertical gap between adjacent vertical heat exchanger plates, for example of a vertical plate freezer. In the case of a horizontal plate freezer, the foodstuff can be loaded and unloaded manually or automatically and this form of freezer is of primary use in the treatment of discrete individual units of the foodstuff, for example containers of prepared meals and the like. In the vertical plate freezer, the foodstuff is usually loaded into the vertical chamber between adjacent plates manually and as a fluent mass of the foodstuff, for example as a slurry, as with a fruit juice or purée, or as a mass of small units of the foodstuff which are not kept discrete, as with a mass of loose fish or meat which is to form a frozen block. For convenience, the invention will be described hereinafter in terms of vertical heat exchange plates, notably a vertical plate freezer, although it can equally be applied to a horizontal plate freezer or other heat exchanger.

Heat exchange fluid flows through bores or conduits within the structure of the heat exchange plate to supply heat to or remove heat from the foodstuff. Such plates are usually large, typically ranging from 0.5 to 2.5 meters by from 1 to 4 meters and are made by extruding the plate from one or more blocks of solid metal. Initially, such plates were made from mild steel, but this was replaced by the use of aluminium as aluminium extrusion techniques became accepted in the metal fabrication industry.

However, despite the advantageous thermal properties of aluminium, its use gives rise to problems. Due to the ease with which aluminium forms a food-soluble oxide/hydroxide on its surface when left in contact with food for prolonged periods, care has to be taken during the use and cleaning of aluminium freezer plates between uses to minimizes the risk of such corrosion and contamination occurring. In some countries, for example the USA, the use of bare aluminium in contact with foodstuffs under conditions where contamination of the foodstuff could occur presents particular health problems. In some applications, for example in the canning of food or beverages, it is possible to apply a protective plastic or other coating to the exposed aluminium surface. However, where solids are being handled, as with blocks of foodstuff or meal portions in metallic containers, abrasion and erosion of surface coatings will occur, notably on load-bearing surfaces as present in a plate freezer. Such coatings are not therefore practical in such applications.

Stainless steel is corrosion resistant and finds widespread use in the food processing industry. Stainless steel cannot be cast or extruded and must therefore be machined or pressed where complex shapes are required. However, stainless steel is difficult to machine and its large scale use has been restricted to applications where the metal can be formed into the desired shape by pressing, for example in heat exchanger plates which are pressed out from sheet metal. It has been considered impractical and uneconomic to manufacture a freezer plate wholly from solid stainless steel.

It has been proposed to fabricate a freezer plate from a serpentine tube, which is to carry the heat exchange fluid, sandwiched between galvanised steel or stainless steel sheets. However, since the tube contacts the adjacent sheets along only a narrow line of contact, such plates give poor and uneven heat transfer from the tube to the sheet. This results in high energy input requirements to operate the plate freezer effectively, and in localised areas of excessive and/or insufficient freezing of the foodstuff in contact with the sheets. In general, such plate freezers have been superseded by the use of extruded aluminium plates which give more uniform freezing of the foodstuff and, due to the high thermal conductivity of aluminium as compared to steel or stainless steel, give greater heat efficiencies.

In an attempt to overcome the poor and uneven heat performance of such sandwich type plates, it has been proposed to fill the internal space in the plate between the tube and the sheets with a eutectic material. Whilst this aids heat transfer between the tube and the sheets and provides a more even thermal transfer over the surface of the sheets, such a system is not suitable for use in vertical plate freezers. In such freezers, the foodstuff is usually frozen as a solid block between the plates. Such a block readily adheres to the faces of the plates and cannot be removed. It is therefore necessary to pass a heating medium through the plate partially to melt the block of frozen material immediately adjacent to the plate surface. With a plate filled with a eutectic fluid, the thermal properties of the fluid prevent rapid heating and cooling of the sheets forming the external faces of the plate. Therefore, any re-heating of the cold plate will occur slowly and extensive partial thawing of the foodstuff block between the plates will occur, which is unacceptable.

Due to the problems of fabrication and thermal efficiency with stainless steel, and despite the problem of potential food contamination, aluminium continues to be used as the material from which plate freezers plates are manufactured. In those cases where unacceptable contamination problems could arise, it has been accepted in the food processing industry that alternative methods for freezing foodstuffs have to be used. Thus, the foodstuff is usually packed in individual closed containers, for example metal cans, and the contents of the containers are frozen by holding the containers in a cold store for several days, which is clearly inefficient and time consuming.

We have now devised a form of freezer plate construction which reduces the above problems.

SUMMARY OF THE INVENTION

Accordingly, the present invention provides a heat exchange device adapted to extract or impart thermal energy from or to a body, which device comprises:

a. a first plate assembly comprising a substantially rigid and planar first sheet member having attached thereto a second sheet member which is substantially congruent to the first member and is formed with localised raised areas extending in either or both directions from the median plane of the second sheet member, the attachment around the periphery of the said sheet members being a sealing attachment so as to provide a generally planar sealed enclosure between the two sheet members, the attachment within the plan area of the enclosure being intermittent and located at the point of contact of at least some of the raised areas of said second sheet member with the opposed planar surface of said first sheet member, there being provided an inlet for a heat exchange fluid to said enclosure and an outlet for heat exchange fluid from said enclosure whereby heat exchange fluid can be caused to flow through said enclosure and cool or warm said first plate assembly; and b. a second plate assembly of substantially the same construction and configuration as said first plate assembly and positioned substantially parallel to said first plate assembly with the second sheet members of the said plate assemblies being opposed to one another.

Preferably, the plate assemblies are mounted in a suitable frame to from a parallelepiped heat exchanger device with the said first planar sheet members of the plate assemblies being exposed as the heat exchange surfaces of the heat exchange device. Thus, the plate assemblies can be mounted in a metal box frame which secures the assemblies parallel to one another and at the desired spacing, but forms with the plate assemblies a closed external surface having the necessary heat exchange fluid inlet and outlet ports or spigots therein.

The plate assemblies can be made from any suitable material, but are preferably made from a stainless steel, notably one which is suitable for use in food processing. For convenience, the invention will be described hereinafter in terms of a stainless steel construction.

The first sheet member is a substantially rigid planar member which provides one exposed face of the heat exchanger device which is to be in direct contact with the material to be heated or cooled by the plate. The exposed face of the sheet member can be polished or otherwise treated or coated to assist relative movement between the material and the heat exchanger device. Preferably, the surface is machine polished and for convenience the invention will be described hereinafter in terms of such a polished sheet.

The second sheet member is preferably also a stainless steel sheet, but since it will not be exposed to the material to be heated or cooled, there will usually be no need to polish or treat the exposed face of the second sheet member. The second sheet member is formed with a plurality of localised raised areas which project beyond the median plane of the sheet. The term median plane is used herein to denote the plane of the sheet from which the raised portions project, which will usually by the same plane as the plane of the non-raised portions of the sheet. The raised portions can extend for any suitable distance from the median plane, for example up to 5 cms to either side of that plane. The raised portions can be formed by any suitable technique, for example by pressing a sheet of stainless steel between suitable press dies or by passing the sheet through the nip gap of suitably shaped rollers. The product is a dimpled sheet which preferably has the peripheral edge thereof configured so that is can be welded or otherwise secured to the first sheet member to form between them the sealed enclosure. The edges of the sheets may also be mounted in sealing engagement with a suitable support frame. The peaks of the dimples or other raised portions directed towards the first sheet member can be attached to the opposed internal face of the first sheet member by spot welding or other suitable means to form a substantially rigid plate assembly having its internal space, or enclosure, subdivided into inter-connecting cells by the points of attachment of the raised portions of the second sheet to the flat surface of the first sheet. If desired, the points of attachment can extend linearly to form line welds or seals between the two sheet to assist the direction of flow of heat exchange fluid through the internal space of the plate assembly. Preferably, such welds or seals are configured to cause heat exchange medium to follow a tortuous path as it flows through the space between the sheet members. If desired, two or more flow paths can be formed, each to carry its own flow of heat exchange medium, notably where it is desired to cool the plate assembly to freeze foodstuff or other material in contact with it and then to heat the plate assembly to assist detachment of the frozen material from the plate assembly.

The plate member is provided with inlet(s) and outlet(s) for heat exchange medium(s) to be fed to and removed from the space between the first and second sheet members. Typically, the inlets and outlets will be provided by conventional spigot type connectors extending laterally from the edge joint between the two sheets in substantially the plane of the plate member. However, the inlets and outlets can extend normally to that plane if required. Typically, a single inlet and outlet will be provided at either end of the path of the flow of heat exchange medium through the space between the sheet members. For example, where there is a single tortuous flow path through the enclosure, one end of that path will be provided with an inlet spigot and the other with an outlet spigot. If desired, the inlets/outlets can be provided upon a box or channel member which forms part of the edge structure of the plate assembly. Such a box or channel member serves as a distribution manifold for directing the flow of fluid into specific flow paths of the enclosure and for collecting fluid from the return portions of those flow paths. The use of such a box or channel member assists mounting and fluid flow connection of the plate assembly. If desired, where the flow paths in the enclosure are directed generally from one edge of the assembly to the other, box or channel members can be mounted at each of those edges and serve as a single inlet or outlet manifold for the plurality of flow paths across the assembly.

In a particularly preferred form of the plate assembly, the second sheet member is more deformable that the first sheet member, for example by being thinner that the first sheet member and/or by being formed of a more ductile grade of stainless steel. The first and second sheets are welded or otherwise secured together along their peripheries and at a plurality of points within their plan area, for example by spot welds or line welds. When gas or fluid under pressure is applied to the space between the sheets via the inlet and/or outlet, the more deformable second sheet member is caused to distend between the attachment points between the sheet to form the raised portions of the second sheet. Plate assemblies formed in this manner are commercially available and may be used as such in the heat exchanger device of the invention.

As indicated above, the heat exchanger plate device of the invention comprises two of the above plate assemblies mounted with their second sheet members carrying the raised portions opposed to one another so that the flat faces of the plate assemblies provide the exposed faces of the heat exchanger plate device. The plate assemblies can be mounted in a suitable support frame, for example a box frame, which forms a sealed edge frame to the overall heat exchanger plate device. Alternatively, the plate assemblies can be formed with their peripheral edges bent or turned over to form a peripheral flange around each plate assembly normal to the plane of the assembly. The flanges of two plate assemblies are interengaged to form a closed box-like structure without the need for a support frame.

The plate assemblies can be mounted so that the dimpled faces of the second sheet members are in contact with one another to minimise the thickness of the overall heat exchanger plate device. Alternatively, the dimpled faces may be separated from one another to provide a further internal space within the heat exchanger plate device through which a further heat exchange medium can flow, for example steam to heat the heat exchanger plate device when freezing of material has be achieved.

The above form of heat exchanger plate device provides a simple and effective method by which a stainless steel heat exchanger plate can be made without the need for expensive and wasteful machining of the plate from solid metal. The plate can be formed in a wide range of sizes and shapes and with a wide range of flow paths through the space between the sheet members using conventional welding and pressing techniques, giving the manufacturer the ability to vary the size and form of the heat exchanger plate to suit the requirements of the customer. This also enables the designer of the chiller, freezer or heater to adopt shapes of heat exchanger plate which optimise the operation of the equipment he is designing.

The heat exchanger plate device of the invention finds widespread use in the treatment of a wide range of materials, for example in the freezing or chilling of fruit juices, fish or meat portions or pre-prepared meal portions in individual containers. The invention therefore further provides a plate freezer in which at least some of the plates are provided by the plates of the invention. However, the heat exchanger plate device can also be used in the heat treatment of foodstuffs or other materials, for example in the pasteurisation or sterilisation of milk or in the cooking of meal portions in individual containers, etc.

The heat exchange fluid which is passed through the space between the two sheets of the plate assemblies can thus be a cooling brine solution, a freezing Freon or similar gas, hot water or steam according to the treatment being carried out. As indicated above, two difference heat exchange media may be used, for example a brine cooling fluid followed by a steam heating cycle.

DESCRIPTION OF THE DRAWINGS

To illustrate the invention, a preferred form thereof will now be described by way of illustration with respect to the accompanying drawings in which.

DESCRIPTION OF THE PREFERRED EMBODIMENT

Figure 1:
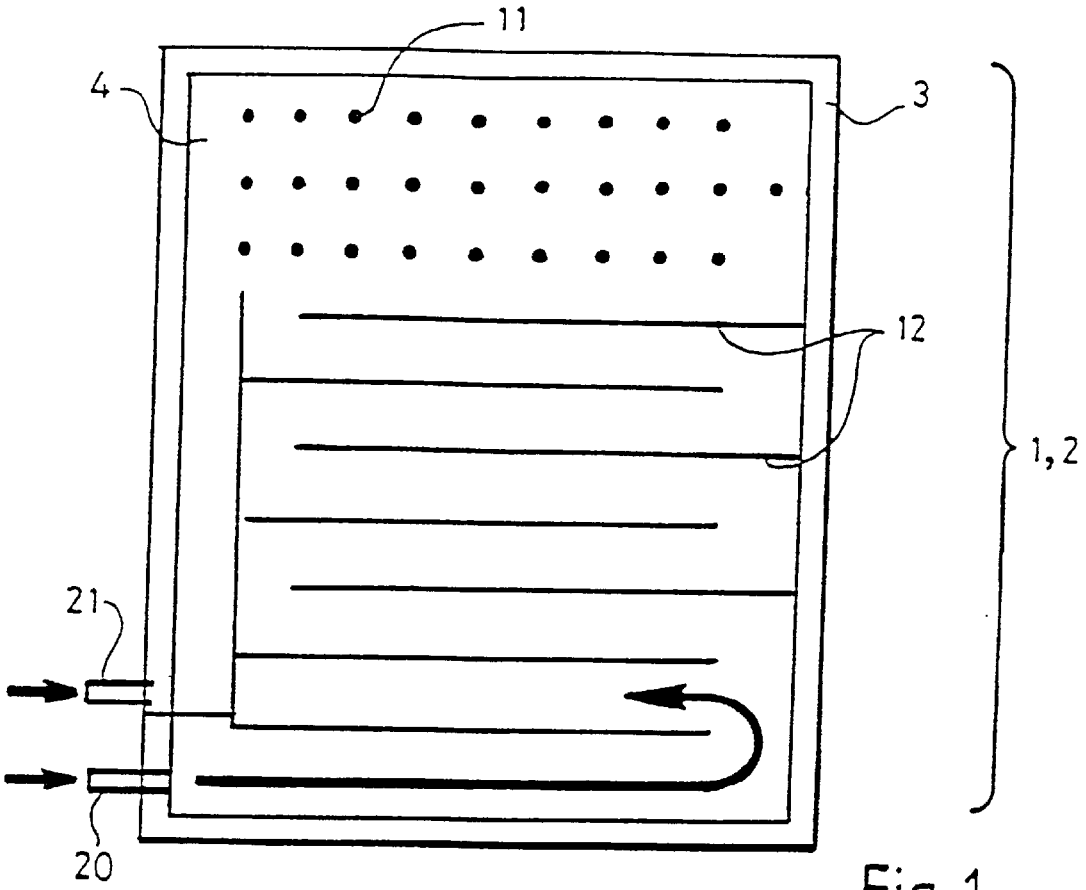
FIG. 1 is a diagrammatic plan view of a heat exchanger plate device of the invention.
Figure 2:
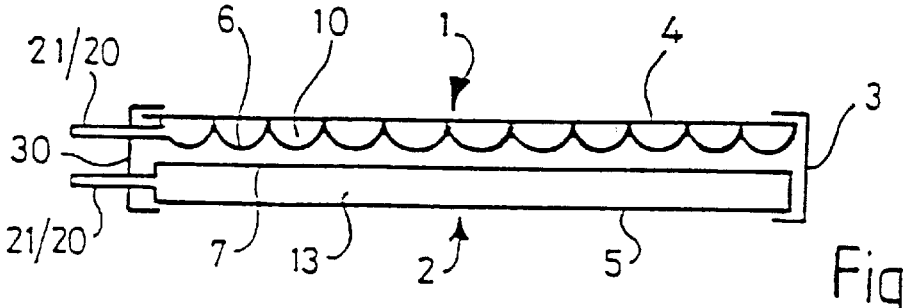
FIG. 2 is a diagrammatic transverse cross section of the heat exchanger plate of FIG. 1.
Figure 3:
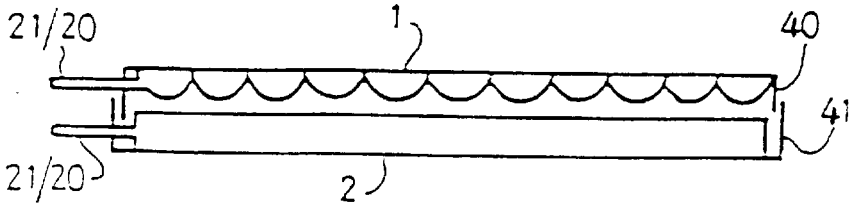
FIG. 3 shows an alternative form of the securing of the two plate assemblies in the heat exchange plate of FIG. 2.
Figure 4:
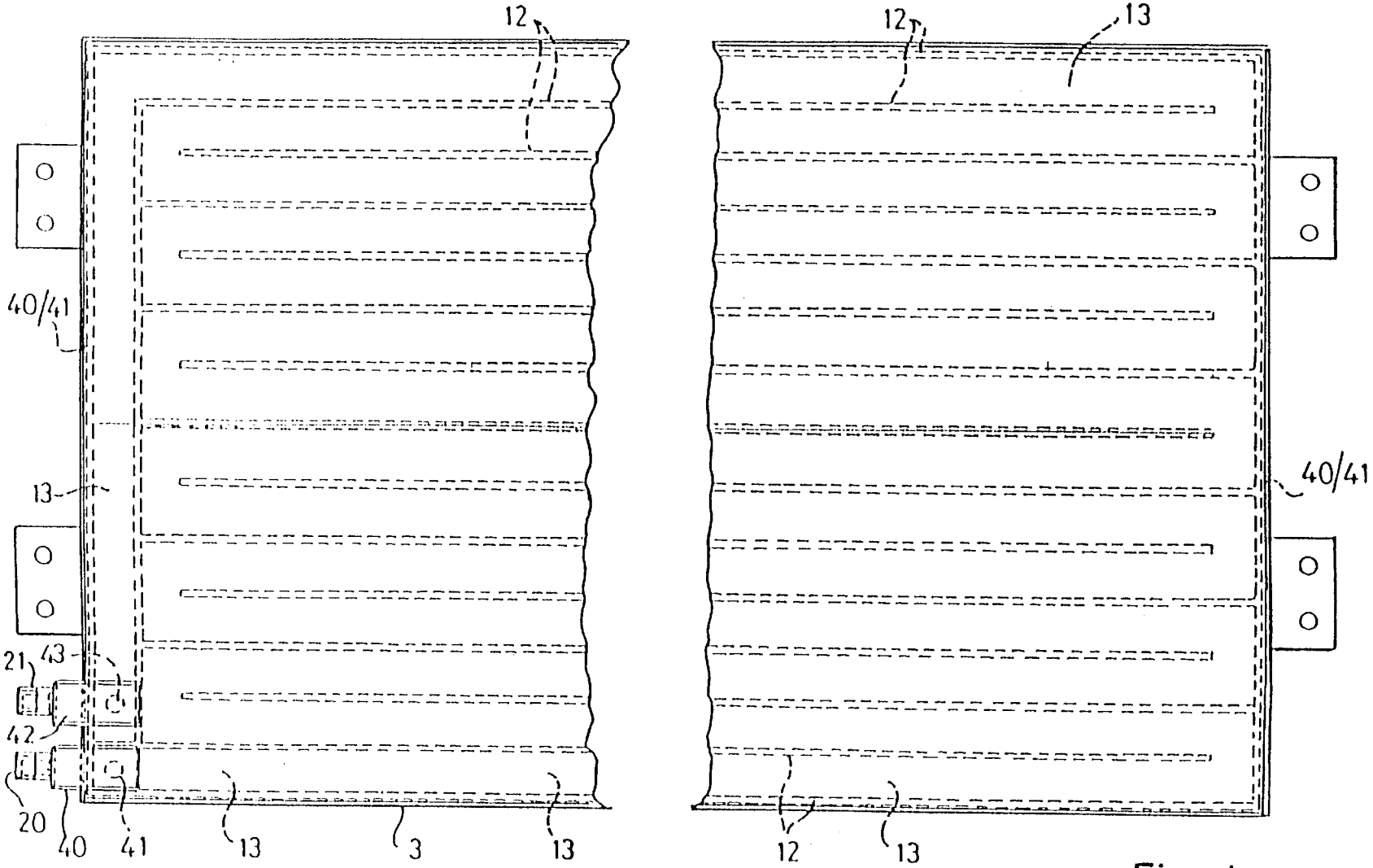
FIG. 4 is a plan view of an alternative form of the heat exchanger device of FIG. 3 having inlet and outlet box-like members.

The heat exchanger plate device comprises two parallel plate assemblies 1 and 2 mounted in parallel opposed relationship to one another in a support frame 3 with the flat first sheet member 4, 5 of the plate assemblies forming the exposed faces of the heat exchanger plate. The second sheet members 6, 7 of the plate assemblies face inwardly towards one another. The second sheet members are formed with raised portions which form, with the opposed face of the first sheet members, a flow passage through the plate assembly, the raised portions can be in the form of rounded dimples 10 in the surface of the second sheet member where the attachment between the first and second sheet members are spot welds or the like, as shown by the dots 11 in FIG. 1 and the arched shape to the cross-section of the upper plate assembly 1 shown in FIG. 2, 3 and 4. Alternatively, the attachment can be linear, as with the line welds 12 shown in FIG. 1, which will give linear tunnel type flow passages 13 as shown in FIGS. 2 and 3. As shown in FIGS. 1 and 4, the linear seals can be staggered in length with alternate seals extending to alternate ends of the assembly to form a tortuous flow path with one or more transverse line seals to provide a terminal return path to the flow outlet.

The first and second sheet members 4, 6 and 5, 7 are secured together around their peripheral edges by welding or any other suitable means to form a closed space between the sheets. An inlet spigot 20 is provided to one end of the tortuous flow path formed by the welds 11 or 12, and an outlet spigot 21 is provided at the other end of that flow path to enable heat exchange medium to flow through the plate assembly along that tortuous flow path. If desired, a further inlet and outlet (not shown) can be provided in the side wall of frame 3 to permit a second heat exchange medium to flow through the space 30 between the opposed faces of the second sheet members 6 and 7.

Figure 5:
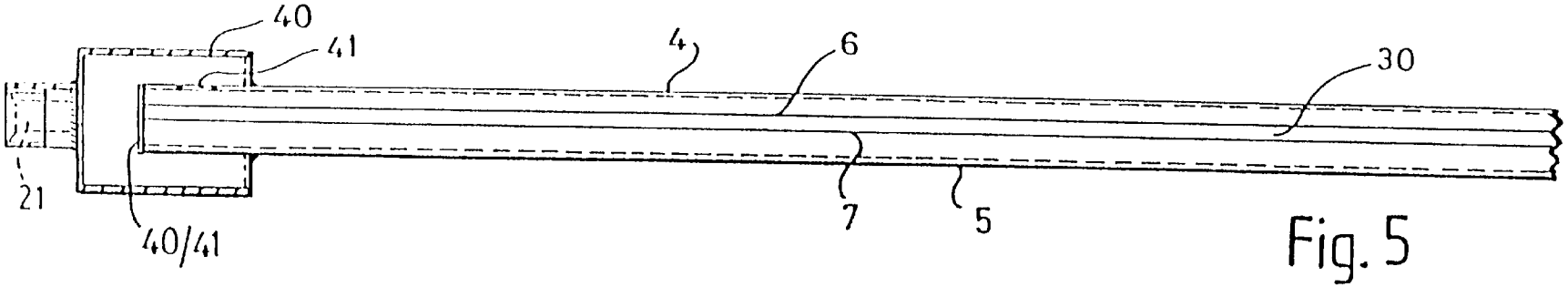
FIG. 5 is an axial cross section through part of the device of FIG. 4.
Figure 6:
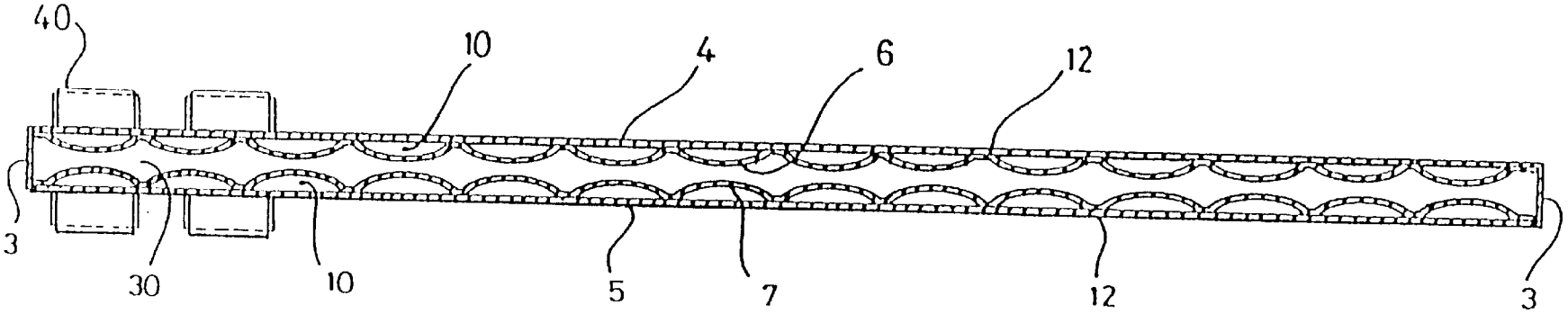
FIG. 6 is a transverse cross section through the device of FIG. 4.

In the alternative form of plate assembly shown in FIGS. 4 to 6, a hollow box member 40 is mounted upon the plate assembly in register with one end of the tortuous flow path through the internal enclosure of the assembly. The wall of the second sheet member has an aperture 41 therethrough which provides fluid flow communication between the interior of the box member 40 and the flow path 13. The box member 40 is provided with an inlet spigot 20 which can be connected to a source of coolant medium. A second hollow box member 42 is mounted on the plate assembly in register with the other end of the tortuous flow path 13 through the plate assembly. The wall of the second sheet member has an aperture 43 to connect the box member 42 with the outlet end of the tortuous flow path 13 and the box member 42 has an outlet spigot 21. Where the flow paths 13 extend as substantially straight lines from one edge of the plate assembly to the opposed edge, the box member 40 can extend along the whole of one edge of the plate assembly and the second sheet member has a series of apertures 41 connecting each flow line 13 with the interior of box member 40. The box member 40 now serves as a manifold inlet serving all the flow paths 13 through the internal enclosure of the plate assembly. Similarly, box member 42 can be mounted at the opposed edge of the plate assembly and can extend along that edge to provide an outlet manifold for the flow paths 13.

As indicated above, such a plate assembly can be formed by welding together a flat first sheet and a pre-formed second sheet. However, it is preferred to form the dimples or tunnel type passages by applying pressure to the internal space between the first and second sheets to cause the second sheet to deform under pressure to beyond its elastic limit and thus form the passages permanently. Individual plate members formed by such a pressure expansion process are commercially available from Frigotecnica Industriale, Chiavenna, Italy.

In operation, coolant or heating fluid is passed through the heat exchanger plate to cool or heat the exposed flat faces of the first sheet members 4 and 5 so as to thermally treat material in contact with those faces. Typically, the heat exchanger plates are arranged in banks of parallel plates to provide a series of treatment cells between the sheet 4 of one plate and sheet 5 of the adjacent plate. Where this is done, the heat exchanger plates of the invention can be mounted in a conventional support frame having mechanised fed and discharge means for the treatment cells and having suitable fed and discharge manifolds for the inlets and outlets of the individual plates as practised in the food processing and other industries. The heat exchanger plates of the invention can thus be readily used in place of conventional plates in existing equipment as well as in new equipment.

As shown in FIG. 3, the edges of the plate members 1 and 2 can be turned over to form interengaging flanges 40, 41, in which case the frame 3 can be dispensed with.

It will be appreciated that the invention can be applied to the construction of plate assemblies which are not planar but have a curved or other configuration. In those cases the first and second sheet members will not be planar.

We claim:

1. A generally planar heat exchanger plate for use in a plate freezer and adapted to extract thermal energy from a body in contact with the plate, characterized in that the heat exchanger plate comprises:

a. a first generally planar plate assembly comprising a substantially rigid first stainless steel sheet member having secured thereto a second sheet member which is substantially congruent to the first member and is formed with localized raised areas extending in either or both directions from the median plane of the second sheet member, the securement around the periphery of the said sheet members being a sealing attachment so as to provide a sealed enclosure between the two sheet members through which a heat exchange medium may flow, the securement within the plan area of the enclosure being intermittent and located at the point of contact of at least some of the raised areas of said second sheet member with the opposed surface of said first sheet member, whereby the securement subdivides the enclosure into a series of interconnecting cells so as to cause a heat exchange medium to follow a tortuous flow path through the enclosure, there being provided an inlet for a heat exchange fluid to said enclosure and an outlet for heat exchange fluid from said enclosure whereby heat exchange fluid can be caused to flow through said enclosure and cool said first plate assembly so as to extract energy substantially uniformly from a body in contact with said first sheet member; and b. a second plate assembly of substantially the same construction and configuration as said first plate assembly;

c. a frame supporting the said first and second plate assemblies in substantially parallel opposed orientation to one another and with said second sheet members positioned substantially parallel and opposed to one another, so as to form a parallelepiped heat exchanger plate having exposed substantially flat faces provided by the said first sheet members which are adapted to contact the body from which thermal energy is to be removed and act as the heat exchange surfaces of the heat exchange plate;

d. the heat exchanger plate being further characterized in that a box-like member is provided at each end of the fluid flow path through the enclosure, a selected one of the first sheet member and the second sheet member provided with an aperture to provide fluid flow communication between the flow path and the interior of the box-like member, and the box-like member provided with a fluid inlet or outlet.

2. A heat exchanger plate as claimed in claim 1, characterized in that the first and second sheet members are secured together within their plan area by spot or line welding.

3. A heat exchanger plate as claimed in claim 1, characterized in that the plate assemblies are spaced apart from one another to provide a second flow path between the opposed second sheet members and fluid flow inlets and outlets are provided to said second flow path.

* * * * *